US007857046B2

(12) United States Patent
Lovell et al.

(10) Patent No.: US 7,857,046 B2
(45) Date of Patent: Dec. 28, 2010

(54) METHODS FOR OBTAINING A WELLBORE SCHEMATIC AND USING SAME FOR WELLBORE SERVICING

(75) Inventors: John R. Lovell, Houston, TX (US); Moussa Kane, Houston, TX (US)

(73) Assignee: Schlumberger Technology Corporation, Sugar Land, TX (US)

( * ) Notice: Subject to any disclaimer, the term of this patent is extended or adjusted under 35 U.S.C. 154(b) by 845 days.

(21) Appl. No.: 11/421,349

(22) Filed: May 31, 2006

(65) Prior Publication Data

US 2007/0277975 A1 Dec. 6, 2007

(51) Int. Cl.
*E21B 47/00* (2006.01)

(52) U.S. Cl. ..... 166/250.01; 166/64; 73/152.02; 73/152.51

(58) Field of Classification Search ..... 166/250.01, 166/64; 73/152.31, 152.27, 152.51, 152.55; 703/10

See application file for complete search history.

(56) References Cited

U.S. PATENT DOCUMENTS 4,741,208 A * 5/1988 Vandevier ..... 73/152.51
4,803,873 A * 2/1989 Ehlig-Economides .... 73/152.31
4,805,449 A * 2/1989 Das ..... 73/152.48
5,019,978 A * 5/1991 Howard et al. ..... 702/6
5,042,296 A * 8/1991 Burgess ..... 73/152.19
5,072,404 A * 12/1991 Schmitzer et al. ..... 700/285
5,148,875 A 9/1992 Karlsson
5,311,951 A 5/1994 Kyte
5,469,916 A * 11/1995 Sas-Jaworsky et al. ..... 166/64
RE35,386 E 12/1996 Wu
5,831,156 A * 11/1998 Mullins ..... 73/152.18
5,865,260 A 2/1999 Jackson
6,018,497 A 1/2000 Gunasekera
6,073,079 A 6/2000 Thomas
6,078,869 A 6/2000 Gunasekera
6,220,087 B1 4/2001 Hache
6,405,808 B1 6/2002 Edwards
6,427,125 B1 * 7/2002 Gzara et al. ..... 702/9
6,450,259 B1 * 9/2002 Song et al. ..... 166/255.1
6,453,239 B1 9/2002 Shirasaka
6,523,623 B1 2/2003 Schuh
6,526,819 B2 3/2003 Demarchos
6,633,816 B2 10/2003 Shirasaka
6,662,884 B2 12/2003 Hemphill
6,668,465 B2 12/2003 Noureldin (Continued)

OTHER PUBLICATIONS

Coiled Tubing Hydraulics Modeling—by Bharath Rao, Tech note, CTES, L.C., May 10, 1999.

*Primary Examiner*—Kenneth Thompson
*Assistant Examiner*—Cathleen R Hutchins
(74) *Attorney, Agent, or Firm*—Michael L. Flynn; David Hofman; Robin Nava

(57) ABSTRACT

Methods are described for determining or estimating a wellbore schematic, one embodiment comprising running one or more measured distances of coiled tubing into a wellbore while pumping a fluid at varying flow rates through the coiled tubing, and calculating true vertical depth of the wellbore using pressure and flow rate data of the fluid. This abstract allows a searcher or other reader to quickly ascertain the subject matter of the disclosure. It may not be used to interpret or limit the scope or meaning of the claims. 37 CFR 1.72(b).

16 Claims, 3 Drawing Sheets

U.S. PATENT DOCUMENTS 6,823,602 B2 11/2004 Noureldin
6,833,699 B2 12/2004 Galford
6,834,732 B2 12/2004 Haarstad
6,837,313 B2 1/2005 Hosie
6,904,981 B2 6/2005 van Riet
6,932,168 B2 8/2005 Morgan
6,957,577 B1 10/2005 Firmin
6,986,396 B2 1/2006 Hemphill
7,021,405 B2 4/2006 Proett
7,027,968 B2 4/2006 Choe
7,044,238 B2 5/2006 Hutchinson
2002/0133958 A1* 9/2002 Noureldin et al. ..... 33/304
2002/0195276 A1 12/2002 Dubinsky
2003/0024738 A1 2/2003 Schuh
2003/0046005 A1 3/2003 Haarstad
2003/0127230 A1* 7/2003 von Eberstein et al. ..... 166/337
2003/0146001 A1 8/2003 Hosie
2003/0196804 A1* 10/2003 Riet ..... 166/267
2003/0205083 A1* 11/2003 Tubel et al. ..... 73/152.19
2004/0129418 A1 7/2004 Jee
2004/0250614 A1* 12/2004 Ander ..... 73/152.05
2004/0253734 A1* 12/2004 Firmin ..... 436/28
2004/0256152 A1 12/2004 Dashevskiy
2004/0257240 A1 12/2004 Chen
2005/0034857 A1* 2/2005 Defretin et al. ..... 166/250.01
2005/0045382 A1 3/2005 Hosie
2005/0060096 A1 3/2005 Hutchinson
2005/0194184 A1 9/2005 Gleitman
2005/0194185 A1 9/2005 Gleitman
2005/0199392 A1* 9/2005 Connell et al. ..... 166/254.2
2005/0209836 A1 9/2005 Klumpen
2005/0209866 A1 9/2005 Veeningen
2005/0209912 A1 9/2005 Veeningen
2005/0211468 A1 9/2005 Veeningen
2005/0216197 A1 9/2005 Zamora
2005/0228905 A1 10/2005 Veeningen
2005/0236184 A1 10/2005 Veeningen
2005/0267719 A1 12/2005 Foucault
2006/0047429 A1 3/2006 Adams
2006/0074561 A1 4/2006 Xia
2006/0106541 A1* 5/2006 Hassan et al. ..... 702/6
2006/0272861 A1* 12/2006 Hutchinson ..... 175/50
2007/0151762 A1* 7/2007 Reitsma ..... 175/40

* cited by examiner

METHODS FOR OBTAINING A WELLBORE SCHEMATIC AND USING SAME FOR WELLBORE SERVICING

BACKGROUND OF THE INVENTION

1. Field of Invention

The present invention relates generally to the field of hydrocarbon production, more particularly to methods for obtaining a wellbore schematic, and using same to monitor wellbore service operations.

2. Related Art

Due primarily to expense issues, the hydrocarbon production industry has come to accept taking surface measurements and making inferences of the downhole status. However, interpretation of real-time wellbore pressure data requires knowledge of the wellbore schematic, in particular the wellbore's variation of depth below the earth surface ("true vertical depth", or TVD) versus its depth along the wellbore axis (measured depth, MD or just "depth"). In circumstances where the wellbore schematic is not known in advance by the interpreter, the wellbore schematic may be obtained directly by including a inclinometer in a downhole tool, but this option is not always available or economical.

In making wellbore pressure interpretations, the pressure read by a downhole meter inside a tubular such as coiled tubing will be the pressure in the tubing at the surface (the "circulating pressure") less friction effects due to flow and plus the hydrostatic pressure, which is proportional to the TVD. For a uniform fluid, the hydrostatic pressure is given by the density of the fluid in ppg times 0.052 psi/ppg/ft. For a typical brine, this works out to approximately 0.5 psi/ft (11.3 kPa/m) of TVD. For a non-uniform fluid, integration along the length of the tubing is required. At zero flow, the TVD is thus given by subtracting the circulating pressure from the bottom-hole pressure and dividing by the constant of proportionality. It is uncommon (and sometimes inefficient) to run coiled tubing into the bottom of the wellbore without pumping fluid, however. When pumping fluid downhole through tubing, the bottom-hole pressure at the terminus of the tubing will be decreased by the friction of the fluid in the tubing. For laminar flow of Newtonian fluids, friction pressure equals a constant multiplied by the flow rate. For turbulent flow of Newtonian fluids, friction pressure equals a constant multiplied by the flow rate squared. In each case the constant of proportionality depends upon the tubing internal geometry as well as the local friction factor between the fluid and the inner tubing surface. For typical fluids pumped through coiled-tubing, there may be a different formula for computing friction loss for the component of the fluid flowing through the spooled coil at the surface, versus that fluid flowing in the tubing hanging in the wellbore. For non-Newtonian fluids, yet more complicated relationships exist between the circulating friction loss and the flow-rate.

In wellbore cleanout procedures and other procedures where liquids are pumped into the wellbore via tubing and out through the annulus, if hydrostatic head pressure may be removed, one has an accurate estimate of the wellbore pressure at the bottom of (entrance to) the annulus. However, the only way to remove the hydrostatic component from downhole data is to have a copy of the wellbore schematic in advance of the job. This schematic could have been obtained while drilling the well via measurement-while-drilling data, or after drilling by lowering a wireline inclinometer tool such as a gyroscope. However, no tool that is currently used for stimulating reservoirs is known to have an internal inclinometry platform, nor is there known any previously existing method to determine TVD strictly from pressure data and flow rate information.

In wellbore cleanout operations, various fill materials are carried by a fluid injected down the wellbore, typically through coiled tubing or other tubulars, and flowed out through the annulus. The cleanout fluid carrying solid particles along the annulus is a suspension whose density correlates with the concentration of solid particles. For an effective cleanout the suspended particles must be transported all the way out of the well. The hydrodynamic pressure in the annulus is directly proportional to the suspension density.

It would be an advance in the art if methods could be devised that provide information about the relationship between TVD vs. MD, in other words the wellbore schematic, while flowing fluids into the wellbore. It would further be an advance in the art to use the obtained wellbore schematic to monitor and/or control wellbore operations, such as wellbore cleanout procedures, via information about the annulus.

SUMMARY OF THE INVENTION

In accordance with the present invention, a wellbore schematic may be estimated from an interpretation of the pressure data itself. Despite the previously-mentioned complications, the designer of a wellbore treatment regime, such as a stimulation treatment, will usually be content to pump a fluid (for example brine) through the tubing for the initial pass into the wellbore. It is during this pass through the wellbore that information about the TVD versus depth may be obtained. Note that it is rather trivial to determine this relationship when not pumping, so one objective of the invention is to derive TVD versus MD relationship while pumping a fluid. Different fluid flow rates may be pumped when different lengths of coiled tubing have been entered into the wellbore. By combining surface measurements of pressure and flow of a known fluid with downhole measurements of pressure, the wellbore schematic may be obtained.

Thus, a first aspect of the invention is a method comprising:

(a) providing a coil of coiled tubing having a length able to reach a determined section of a wellbore;

(b) running measured distances of the coiled tubing into a wellbore while pumping a fluid at varying flow rates through the coiled tubing;

(c) measuring circulating pressure and pressure at bottom of the wellbore at various times during running and pumping; and (d) calculating wellbore parameters of the wellbore at the one or more measured distances using the pressure and flow rate data.

Methods within this aspect of the invention include methods wherein the wellbore parameters include true vertical depth of the wellbore along the length of the wellbore, and methods comprising cross-plotting the true vertical depth versus the measured distances as a function of time. As used herein "circulating pressure" means the pressure of the circulating fluid measured at the surface just before it enters the coiled tubing. One embodiment comprises pumping a sequence of fluid flow regimes into the wellbore at measured circulation pressures and flow rates, sending bottom-hole data to the surface, and fitting the data to find the wellbore geometry assuming a minimal radius of curvature for the wellbore. The true vertical depth may be cross-plotted versus measured distance as a function of time. Methods include those wherein the density of the pumped fluid is constant or varies, such as when a wellbore cleanout fluid picks up particles from the wellbore and transfers the particles with the fluid out through the annulus of the wellbore. When the density of the fluid changes, a second calculation using pressure measurements at the surface and in the wellbore may be used to calculate, and recalculate if necessary or desired, the fluid density. Alternatively, the density of the pumped fluid may simply be monitored for change of density.

Methods within this aspect of the invention include sending real-time pressure data to the surface during wellbore stimulation using one or more methods selected from wireless methods (such as mud-pulse electromagnetic telemetry), wire methods via a data-carrying wire (such as an eline cable), and fiber-optic lines. The wireless methods may be used particularly when running in joints of tubing. In other embodiments the tubing is brought to the well spooled onto a reel with a telemetry cable already inserted into the spool, but the invention is not so limited. The wireline may be inserted into the tubing at the well site. An advantage of fiber-optic telemetry is that the bottom-hole pressure may be measured without the need for downhole electronics. Indeed, if one has downhole electronics, then an inclinometer may be added to the electronics package for minimal additional cost, so one of the prime advantages of this invention is for bottom-hole assemblies without an electronics package. Fiber-optic techniques to measure pressure are well-known in the industry. One common device relies on interferometry to identify the size of a cavity, that cavity itself changing size based on the external pressure applied to the cavity. Such devices are made, for example, by FISO Technologies in Montreal, Canada and have been recently implemented in the bottom-hole assemblies. Certain methods of this aspect of the invention comprise repeating steps (b), (c), and (d) during repeated passes of the tubing through the wellbore. This may result in more certainty regarding the wellbore schematic.

Once the wellbore schematic is estimated then the same information on the wellbore and fluids may be used to analyze the annulus around the coil. Thus, another aspect of the invention is a method comprising:

(a) pumping a fluid at a wellhead down a wellbore through coiled tubing and measuring pressure and flow rate of the fluid at the wellhead and down the wellbore at a terminus of the coiled tubing, the fluid flowing out of the wellbore through an annulus; and (b) monitoring presence of particles in the fluid with or without detecting variations in their concentration.

One method according to this aspect of the invention comprises calculating the flowing fluid stream density in the annulus, or monitoring variations in fluid density in the annulus. Another method comprises quantifying the amount of fill material removed from the wellbore. In this respect, the methods are an alternative or complement to solids detection in annulus fluids at the wellhead.

Methods within this aspect of the invention include those wherein the wellbore is selected from substantially vertical wellbores, deviated wellbores, and combinations thereof. Other methods comprise determining the quantity $f^*k_{geo}$ in the respective vertical and deviated instances, wherein f is the friction coefficient and $k_{geo}$ is a constant that depends on the geometry of the annulus. In certain methods if the quantity $f^*k_{geo}$ is known, the density of the fluid in the annulus may be quantified, and therefore the concentration of particles in the fluid. This provides a method to monitor cleanout efficiency of a pumped cleanout fluid carrying the particles to the surface. The quantity $f^*k_{geo}$ may be determined during a period of flow where no cleaning is taking place, in other words with no particles in suspension, so that density is known. Alternatively, a plot may be made of the difference between annulus pressure and wellhead pressure as a function of length of tubing in the wellbore, with a set of pre-defined constant density lines. Another alternative is to calculate fluid density at zero flow rate, which may be achieved using short pumping interruptions. As will be shown, this allows calculation of fluid density without the need of taking into account the friction. Such pumping interruptions may only be possible if the particle settling time is sufficiently long, for example with gel fluids.

The method may be a wellbore cleanout operation, and the methods may be monitored. In the context of wellbore cleanout operations, another aspect of the invention is a computation method comprising measuring wellhead pressure at surface, at the flow exit, measuring annulus bottom hole pressure, at the end of the CT string, and measuring the length of coiled tubing run in the wellbore, and determining the qualitative relationship between annulus fluid density and flow rate, without knowing the friction factor or $k_{geo}$ factor for the annulus. Knowing the latter two quantities allows a quantitative measure of annulus fluid density.

Methods of the invention may be used with one or more oilfield tool components. The term "oilfield tool component" includes oilfield tools, tool strings, deployment bars, coiled tubing, jointed tubing, wireline sections, slickline sections, combinations thereof, and the like adapted to be run through one or more oilfield pressure control components. The term "oilfield pressure control component" may include a BOP, a lubricator, a riser pipe, a wellhead, or combinations thereof.

Advantages of the methods of the invention include combining the operations of determining the wellbore schematic with one or more fluid flow regimes at a well site, thus saving time. Determination of a wellbore schematic during fluid injection also eliminates the need for an instrumented bottom hole assembly, possibly allowing more efficient wellbore operations, and provides the opportunity for obtaining more information on annular fluids without having to calculate friction coefficient of the annulus.

Methods of the invention may become more apparent upon review of the brief description of the drawings, the detailed description of the invention, and the claims that follow.

BRIEF DESCRIPTION OF THE DRAWINGS

The manner in which the objectives of the invention and other desirable characteristics may be obtained is explained in the following description and attached drawings in which.

Figure 1:
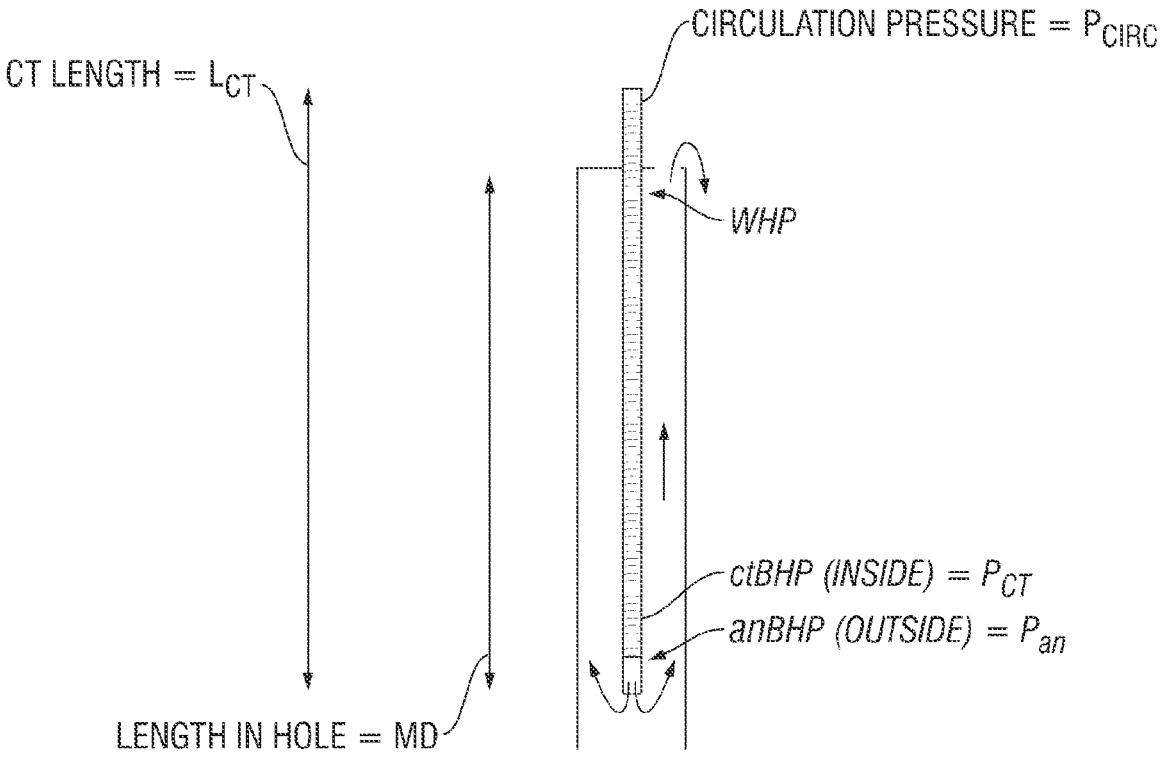
FIG. 1. is a schematic cross-sectional view of a wellbore illustrating calculation parameters for one method of the invention.

It is to be noted, however, that the appended drawings are not to scale and illustrate only typical embodiments of this invention, and are therefore not to be considered limiting of its scope, for the invention may admit to other equally effective embodiments.

DETAILED DESCRIPTION

In the following description, numerous details are set forth to provide an understanding of the present invention. However, it may be understood by those skilled in the art that the present invention may be practiced without these details and that numerous variations or modifications from the described embodiments may be possible.

All phrases, derivations, collocations and multiword expressions used herein, in particular in the claims that follow, are expressly not limited to nouns and verbs. It is apparent that meanings are not just expressed by nouns and verbs or single words. Languages use a variety of ways to express content. The existence of inventive concepts and the ways in which these are expressed varies in language-cultures. For example, many lexicalized compounds in Germanic languages are often expressed as adjective-noun combinations, noun-preposition-noun combinations or derivations in Romanic languages. The possibility to include phrases, derivations and collocations in the claims is essential for high-quality patents, making it possible to reduce expressions to their conceptual content, and all possible conceptual combinations of words that are compatible with such content (either within a language or across languages) are intended to be included in the used phrases.

The invention describes methods for obtaining a wellbore schematic, defined as the relationship between true vertical distance (TVD) and measured distance (MD) of a tubular in a wellbore. Currently, in wellbore cleanout procedures and other procedures where liquids are pumped into the wellbore via tubing and out through the annulus, if hydrostatic head pressure may be removed, one has an accurate estimate of the wellbore pressure at the bottom of (entrance to) the annulus. However, the only way to remove the hydrostatic component from downhole data is to have a copy of the wellbore schematic in advance of the job. This schematic could have been obtained while drilling the well via measurement-while-drilling data, or after drilling by lowering a wireline inclinometer tool such as a gyroscope. However, no tool that is currently used for stimulating reservoirs is known to have an internal inclinometry platform, nor is there known any previously existing method to determine TVD strictly from pressure data and flow rate information. Another challenge is in so-called wellbore cleanout operations, wherein various fill materials are carried by a fluid injected down the wellbore, typically through coiled tubing or other tubulars, and flowed out through the annulus. The cleanout fluid carrying solid particles along the annulus is a suspension whose density correlates with the concentration of solid particles. For an effective cleanout the suspended particles must be transported all the way out of the well. The hydrodynamic pressure in the annulus is directly proportional to the suspension density. It would be an advance in the art if methods could be devised that provide information about the relationship between TVD vs. MD, in other words the wellbore schematic, while flowing fluids into the wellbore. It would further be an advance in the art to use the obtained wellbore schematic to monitor and/or control wellbore operations, such as wellbore cleanout procedures, via information about the annulus. There is a continuing need for systems and methods that address one or more of these challenges.

As used herein "wellbore schematic" means the relationship between true vertical depth and measured depth, where measured depth is the depth measured at the wellhead of coiled tubing that has entered the wellbore. As used herein "annulus fluid" and "annular fluid" may be used interchangeably and refer to the fluid traversing past a coiled tubing back to the surface. As used herein "wellbore servicing" means any operation designed to increase hydrocarbon recovery from a reservoir, reduce non-hydrocarbon recovery (when non-hydrocarbons are present), or combinations thereof, involving the step of pumping a fluid into a wellbore, or into coiled tubing that is or will be placed into the wellbore. This includes pumping fluid into a reeled or spooled coil of coiled tubing. The fluid pumped may be a composition to increase the production of a hydrocarbon-bearing zone, a composition pumped into other zones to block their permeability or porosity, a composition designed to flush or cleanout a wellbore or portion thereof, and the like. Methods of the invention may include pumping fluids to stabilize sections of the wellbore to stop sand production, for example, or pumping a cementatious fluid down a wellbore, in which case the fluid being pumped may penetrate into the completion (e.g. down the innermost tubular and then up the exterior of the tubular in the annulus between that tubular and the rock) and provide mechanical integrity to the wellbore. As used here in the phrases "treatment" and "servicing" are thus broader than "stimulation". In many applications, when the rock is largely composed of carbonates, one of the fluids may include an acid and the hydrocarbon increase comes from directly increasing the porosity and permeability of the rock matrix. In other applications, often sandstones, the stages may include proppant or additional materials added to the fluid, so that the pressure of the fluid fractures the rock hydraulically and the proppant is carried behind so as to keep the fractures from resealing. The details are covered in most standard well service texts and are known to those skilled in the well service art so are omitted here.

Methods within this aspect of the invention include sending real-time pressure data to the surface during wellbore servicing using one or methods selected from wireless methods (such as mud-pulse electromagnetic telemetry), wire methods via a data-carrying wire (such as an eline cable), and fiber-optic lines. The wireless methods may be used particularly when running in joints of tubing. In other embodiments the tubing is brought to the well spooled onto a reel with a telemetry cable already inserted into the spool, but the invention is not so limited. The wireline may be inserted into the tubing at the well site. An advantage of fiber-optic telemetry is that the bottom-hole pressure may be measured without the need for downhole electronics. Indeed, if one has downhole electronics, then an inclinometer may be added to the electronic package for minimal additional cost, so one of the prime advantages of this invention is for bottom-hole assemblies without an electronics package. Fiber-optic techniques to measure pressure are well-known in the industry. One common device relies on interferometry to identify the size of a cavity, that cavity itself changing size based on the external pressure applied to the cavity. Such devices are made, for example, by FISO Technologies in Montreal, Canada and have been implemented in the bottom-hole assemblies.

Exemplary methods of the invention rely on running tubing into the bottom of a wellbore while pumping a fluid therethrough at varying rates while running in. The fluid may be one in which the friction drop down tubing, such as coiled tubing, behaves according to a power-law relationship:

$$\text{friction pressure}=A^*(\text{flow rate})^n,$$

where n is an exponent (typically between 1 and 2) and A depends on (i.e., is a function of) viscosity of the fluid, local friction effects and tubular internal diameter. The pressure measured at the bottom of the tubing will be given by the circulating pressure (measured at the surface) less the friction pressure through the tubing plus the hydrostatic pressure. The friction pressure in the coiled tubing may be best modeled as two components:

$$\text{friction pressure}=A_1^*(\text{flow rate})^{n1}+A_2^*(\text{flow rate})^{n2}$$

where the first term to the right of the equal sign represents the pressure drop along that part of the coil wound around a spool, and the second term to the right to the equal sign represents the pressure drop along the unspooled coil. This latter component may be taken to be proportional to the length of coil run into the wellbore, so surface measurement of this length will be needed. Apparatus for such measurements are commercially available and well-known in the industry. For example, small wheels may be pushed against the coil and the rotation of those wheels will give the length of the coil run in. One embodiment is that known under the trade designation UTLM, from Schlumberger. The first component of the friction pressure may be modeled either as a formula which takes into account the changing diameter of the spooled coil, or more simply may be taken as proportional to the length of coil wound around the spool. Thus if there is a total of $L_T$ feet brought to the rig and MD(t) has been run into the ground at time t, then the friction pressure may take the form:

$$\text{friction pressure}=a_1*(L_T-MD(t))*(\text{flow rate}(t))^{n1}+a_2*MD(t)*(\text{flow rate}(t))^{n2}.$$

In order to determine the unknown coefficients $a_1$ and $a_2$, and the exponents n1 and n2, the flow rate and MD as the coil is run in may be varied with time. The hydrostatic pressure will be proportional to the density of the fluid times its TVD. In many embodiments the density of the pumped fluid varies with depth and flow rate; however, in some embodiments the density may be assumed to be fixed, so the hydrostatic term becomes:

$$\text{hydrostatic pressure}=TVD(t)*\text{density}*\text{gravity}.$$

One method of the invention is thus to find a best fit of the parameters (TVD(t) vs. MD(t)) which matches up the sum of the theoretical friction pressure and hydrostatic pressure against the difference of the measured circulating and bottomhole pressures. This best fit may be done with a number of techniques for non-linear optimization. Such programs are readily available in software packages, such as Matlab. The result is then a cross-plot of TVD(t) versus MD(t) at each time. This is precisely the wellbore schematic. The terminology Y(t) may be used to denote the difference between theoretical pressure drop in the coil against the measured pressure drop.

In the unlikely event that the density of the fluid is not known at the beginning of the job, it may be estimated if the wellbore schematic is at least known at the top of the wellbore, e.g., if the top of the wellbore is vertical. This estimate could then be used for the rest of the inversion.

The nature of nonlinear parameter estimation means that the plot of TVD(t) versus MD(t) will be quite noisy. This estimation may be made more robust by adding additional information such as the maximum dogleg angle of the wellbore. A second piece of information is that the borehole inclination may only change quite slowly with depth. A standard practice in the industry is to assume that the borehole schematic follows a so-called minimum radius of curvature. While drilling the well, periodic measurements of inclination are passed to the surface. The inclination between two such measurements is determined by fitting an arc of a circle of fixed radius such that the inclinations at the ends of the arc match the measured inclinations. In effect, the wellbore schematic is that combination of arcs that has a fixed radius between each measurement of inclination. We may use this methodology in the derivation of the wellbore schematic from pressure.

The unknown parameters become $a_1$, $a_2$, $n^1$ and $n^2$ and a series of inclinations, θ(MD), where θ is the inclination angle and MD is the length of coil run into the well. The nonlinear estimation will then minimize the sum of $Y(t)^2+Z(t)^2$ where Z(t) is a weighting term constraining the rate of change of θ. There are well-known techniques to constrain rate of change. One standard formula is the sum of the absolute value:

$$\text{rate of change}=|\theta(MD(j+1))-\theta(MD(j))|$$

for a predetermined selection of depths MD(1), MD(2), . . . . A typical selection of depths would be fixed interval of 10 m or 30 ft along the length of the wellbore. The result of this optimization is not just the wellbore schematic. The parametric values in the friction expression are in themselves useful because they may give indications of viscosity and the nature of the flow—for example, the exponent of the flow is indicative of the flow profile, whether it is laminar or turbulent. See for example, Bird, et al., "*Transport Phenomena*", Chapter 6, pp. 180-190, John Wiley & Sons (1960).

Once the wellbore schematic is estimated then the same information on the wellbore schematic and pressure of fluids may be used to analyze the annulus fluid around the coil. The pressure drop between the bottomhole and the wellhead is the sum of the hydrostatic and friction pressures in the annulus, plus the effect of the reservoir (e.g. whether it is causing a net increase in pressure in the annulus or a decrease). Also the hydrostatic pressure at a given depth may be subtracted from the annular bottomhole pressure to get directly the effect of the formation pressure (and the changes in that formation pressure vs. time). For example, if the tool is stationary then the hydrostatic pressure may be subtracted from pressure measurements during a fall-off and formation parameters may be estimated using standard well-testing techniques. If the tool is not stationary, then to be able to use such techniques requires subtracting of the varying hydrostatic pressure versus depth. Interestingly, if there is a small error in the input fluid density then there will be a corresponding error in estimated TVD, but this would not then translate into an error in the estimated hydrostatic versus depth.

It is important that the flow-rate be varied during the run in the well. If a fixed flow-rate is used then deriving the parameters $a_1$, $a_2$, n1 and n2 will be very unstable.

Note that there is a significant advantage in transmitting the bottom-hole pressure in real-time because then the wellbore schematic may be determined without having to extract the coiled tubing.

Further, note that in a typical coiled tubing operation, there will be repeated passes through the wellbore, so that during the course of the operation, the uncertainty in the wellbore schematic will be removed. The surface operator (or his computer) will need to monitor which fluids are being pumped, which in turn would allow parameters $a_1$, $a_2$, n1, n2 and density to vary from one fluid to the next.

Referring now to the drawing figures, FIG. 1 is a schematic cross-sectional view of a wellbore illustrating general configuration, measurements and parameters involved for one method of the invention.

Measurements (see FIG. 1):

Wellhead pressure: WHP, measured at surface at the flow exit.

Circulation pressure: $P_{circ}$, measured at surface, inside the CT at the 'in' extremity.

Annulus bottom hole pressure: $P_{an}$, measured in the wellbore, at the end of the CT string.

CT bottom bole pressure: $P_{CT}$, measured inside the CT, at the bottom end.

Parameters:

Total CT string length: $L_T$

CT length in hole: MD

Wellbore, CT radii (resp. diameters): $r_w$, $r_{CT}$ (resp. $d_w$, $d_{CT}$).

Friction coefficient: f annulus fluid velocity: $\upsilon_{an}$.

The four measured pressures are linked by the following relationships:

$$P_{an}=WHP+F_{an}+H_{an} \tag{1}$$

$$P_{CT}=P_{circ}-F_{CT}+H_{CT} \tag{2}$$

$$P_{CT}=P_{an}+DP_{nozzle} \tag{3}$$

$DP_{nozzle}$ is the differential pressure across the nozzle fitted at the end of the CT.

Notations: F for friction pressure, H for hydrostatic pressure. The subscripts 'an' and 'CT' stand respectively for 'in the annulus or wellbore' and 'inside the coiled tubing'.

With the annulus friction pressure—in theory calculable—and the measured annulus and wellhead pressures, the quantity of interest, the annulus hydrostatic pressure, is inferred from (1):

$$H_{an}=P_{an}-WHP-F_{an} \tag{1a}$$

The hydrostatic pressure is also:

$$H_{an}=\rho_{an}\cdot g\cdot TVD \tag{4}$$

wherein TVD is the vertical depth, equal to MD as defined above in a vertical well. We therefore obtain the average annulus fluid density $\rho_{an}$:

$$\rho_{an}=\frac{H_{an}}{g\cdot TVD} \tag{4a}$$

Obtaining the annulus friction pressure:

The friction in the wellbore is given by (with the usual assumptions):

$$F_{an}=f\cdot\rho_{an}\cdot v_{an}^2\cdot\frac{MD}{r_w-r_{CT}} \tag{5}$$

Note: The density may vary along the annulus, i.e., $\rho=\rho(MD)$. $\rho_{an}$ in (5) is the average annulus fluid density given by:

$$\rho_{an}=\frac{\int\rho(MD)\cdot dMD}{\int dMD} \tag{6}$$

and the friction pressure is:

$$F_{an}=\int f\cdot\rho(MD)\cdot\frac{v_{an}^2}{r_w-r_{CT}}\cdot dMD \tag{7}$$

Combining the two relations above leads to equation (5).

The annulus friction pressure is a function of the annulus fluid density, i.e., the friction term in (1a) cannot be accessed without knowing the density. An estimate of the density can be used in (5) to get the friction loss, and then re-adjusted at each computation cycle after the set of equations (1a, 4a) has been solved. The friction term could be very inaccurate, one of the reasons being that it requires the friction coefficient f, which has large uncertainties.

The following scheme gives the variations of the annulus fluid density without having to calculate the friction pressure.

Case 1: Vertical well.

Equation (5) may be re-written:

$$F_{an}=MD\,\rho_{an}fk_{geo}\upsilon^2_{an} \tag{8}$$

where $k_{geo}$ is a constant that depends on the geometry of the system. Note that equation (8) is not specific to the vertical case where, as noted previously TVD is equal to MD.

From equations (1, 4, 8) one obtains equations (9) and (9a):

$$P_{an}-WHP=MD\cdot\rho_{an}\cdot g\cdot\left(1+\frac{f\cdot k_{geo}}{g}\cdot v_{an}^2\right) \tag{9}$$

$$\frac{P_{an}-WHP}{MD}=\rho_{an}\cdot g\cdot\left(1+\frac{f\cdot k_{geo}}{g}\cdot v_{an}^2\right) \tag{9a}$$

The difference between the downhole annulus pressure and the wellhead pressure is proportional to the hydrodynamic pressure and density for any given flow rate. It follows that:

Even without knowing the friction in the annulus, the measured quantity ($P_{an}$−WHP)/MD gives the variations of the density in the annulus.

With $f*k_{geo}$ known the method is quantitative (both f and $k_{geo}$ are accessible, an experimental method for estimating the product $f*k_{geo}$ is described further).

Case 2: Deviated well.

Figure 2:
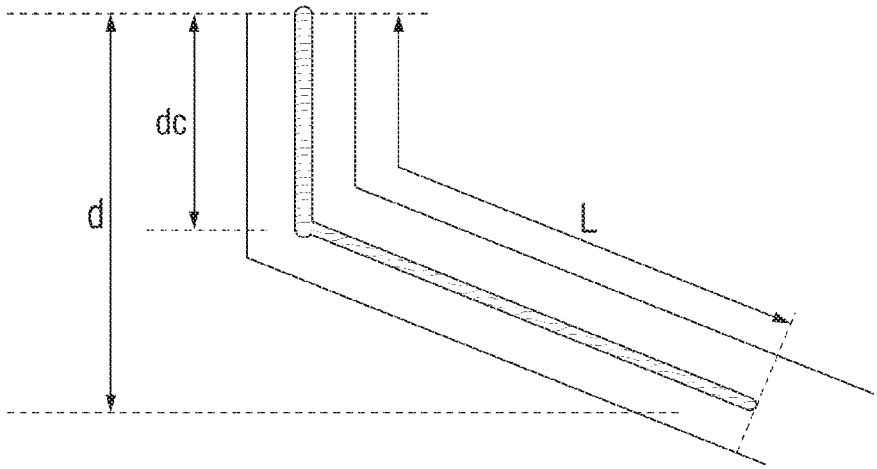
FIG. 2 is a schematic cross-sectional view of a partially vertical and partially deviated wellbore illustrating calculation parameters for another method of the invention.

In a deviated well we lose the proportionality between $H_{an}$ and MD. Assuming a constant deviation, if m is the cosine (deviation angle), and reviewing FIG. 2 herein:

$$H_{an}\rho_{an}\cdot g\cdot[MD_0+m\cdot(MD-MD_0)] \tag{10}$$

and from equations (1, 8, and 10), equations 11 and 11a may be obtained:

$$P_{an}-WHP=\rho_{an}\cdot(f\cdot k_{geo}\cdot v_{an}^2+g\cdot m)\cdot MD+\rho_{an}\cdot g\cdot(1-m)\cdot MD_0 \tag{11}$$

$$\frac{P_{an}-WHP}{MD}=\rho_{an}\cdot(f\cdot k_{geo}\cdot v_{an}^2+g\cdot m)+\rho_{an}\cdot g\cdot(1-m)\cdot\frac{MD_0}{MD} \tag{11a}$$

Equation (11) may be solved for $\rho_{an}$, given the well configuration. Another option is a chart of ($P_{an}$−WHP) vs. MD with a set of pre-defined constant-density lines.

Friction test, an experimental method for estimating the product $f*k_{geo}$:

While in hole, a friction test could be performed based on equations (9) or (11).

Before starting cleaning, i.e., no particles in suspension, equations (9 or 11) may be solved for the quantity $f*k_{geo}$ which characterizes the friction. This must be done before reaching the treatment zone so as to have a density well defined (density of the injected fluid).

Interrupted Flow Test

While flowing, short pump interruptions ($v_{an}=0$) will allow solving equations (9, 11) for "$\rho_{an}$" without the need of taking into account friction. Such pumping interruptions may only be possible when the particles' settling times are long enough, i.e., with gel fluids and the like.

Figure 3:
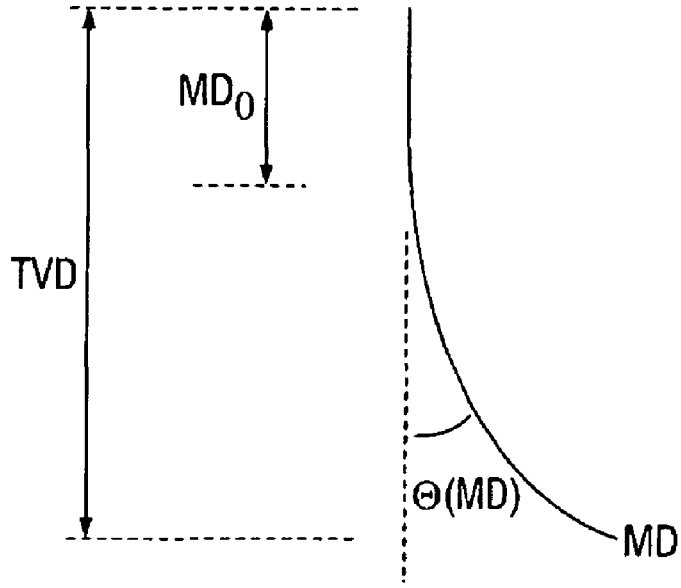
FIG. 3 is an illustration useful for a method of derivation of well deviation and TVD.

Derivation of well deviation and TVD (cf FIG. 3).

The well has a vertical section of length $MD_0$, the wellbore deviation is a function of the measured depth MD. The friction pressure is still given by (7):

$$F_{an} = \int f \cdot \rho(MD) \cdot \frac{v_{an}^2}{r_w - r_{CT}} \cdot dMD \tag{7}$$

The hydrostatic pressure is:

$$H_{an}=\int\rho(MD)\cdot g\cdot\cos[\theta(MD)]\cdot dMD \tag{12}$$

From (1, 7, 12):

$$P_{an}-WHP=\int\rho(MD)\cdot g\cos[\theta(MD)]\cdot dMD+\int\rho(MD)\cdot f\cdot k_{geo}v_{an}^{2}\cdot dMD \tag{13}$$

Differentiating equation (13) with respect to MD one gets equation (14):

$$\frac{d(P_{an} - WHP)}{dMD} = \begin{matrix}\rho(MD)\cdot g\cdot\cos[\theta(MD)] + \\ \rho(MD)\cdot f\cdot k_{geo}\cdot v_{an}^2\end{matrix} \tag{14}$$

The left hand side of (14) is measured. Equation (14) may be solved for ρ(MD) given the well trajectory (i.e. cos [θ(MD)] vs. MD) or for cos [θ(MD) given the density (i.e. ρ(MD) vs. MD). After equation (14) is solved the TVD may be obtained through:

$$TVD=\int\cos[\theta(MD)]\cdot dMD \tag{15}$$

Figure 4A:
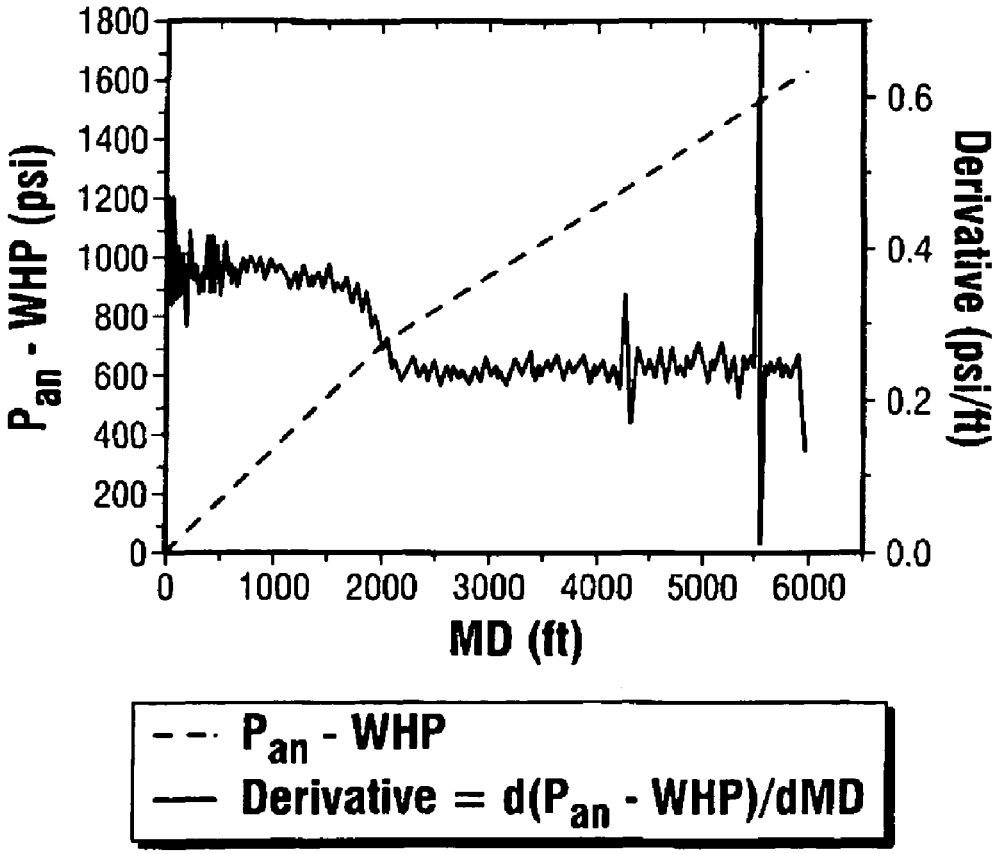
FIGS. 4A, 4B, and 4C illustrate an example of application of the method of FIG. 3.
Figure 4B:
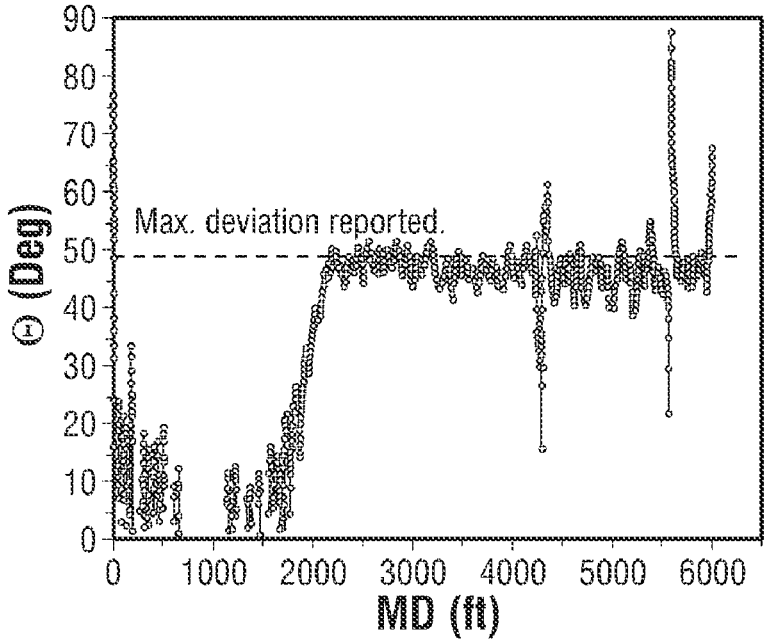
Figure 4C:
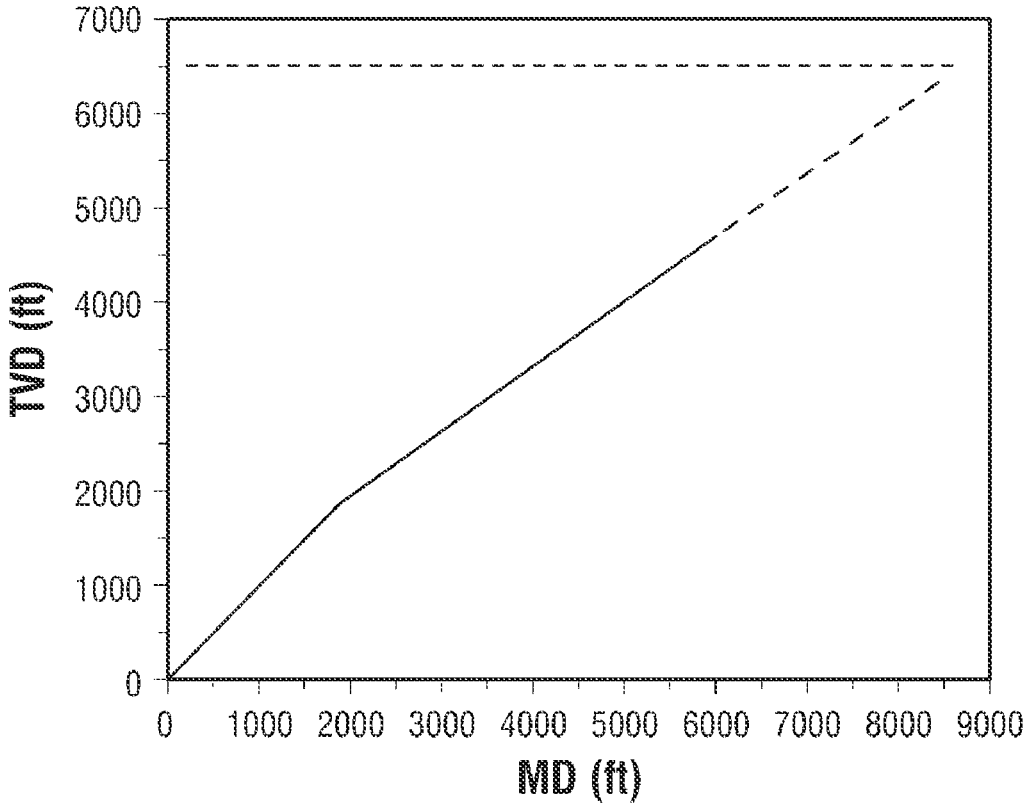

FIGS. 4(*a, b, c*) illustrate an example of application of the method. In this example, given the diameter of the wellbore and fluid flow rate, the friction term is negligible compared to the hydrostatic term. The density, which is constant, is determined while in the vertical portion of the well.

In many cases, it is advantageous to drain a reservoir with a multiplicity of wellbore branches connected together downhole to a main trunk wellbore, in the similar way that the roots of a plant retrieve water from the soil. Such wellbores are referred to as multilaterals, with each branch being referred to as a lateral. In such circumstances, it is important to know which branch of the reservoir has been penetrated by the coiled tubing. Using one or more embodiments of the invention described herein, a wellbore schematic can be determined from parameters measured on the coiled tubing. The derived wellbore schematic can be compared to a schematic of the multilateral well, and thereby identify which of the laterals has been penetrated. Note that only an approximate schematic is needed of the overall multilateral reservoir. As the coiled tubing penetrates a particular lateral, then a more accurate description of the multilateral reservoir can be obtained. With the help of an entry sub at the end of the coiled tubing, it is possible to enter many, or all, the laterals and so obtain a complete multilateral schematic.

Knowing which lateral has been penetrated is also important to optimize the reservoir stimulation. For example, if a water is being produced out of one lateral and hydrocarbon out of a second, then the operator will desire to pump a stimulating fluid, such as acid, into the hydrocarbon-containing lateral, and the operator will desire to pump a non-stimulating or viscous fluid, such as a gel, into the water-containing lateral. If these fluids were to be pumped into the wrong laterals, then overall hydrocarbon recovery would be ruined. Similarly, if many laterals are penetrating hydrocarbon, then it will be efficient to add stimulating fluids to each lateral. If the coiled tubing should accidentally re-enter an already stimulated lateral, then it is disadvantageous to pump more stimulating fluid into that lateral. In this way, it can be seen that increasing knowledge of the wellbore schematic penetrated by the coiled tubing is a means to increase overall hydrocarbon productivity. The ability to selectively choose fluids is only one such example of how to use wellbore information to increase overall hydrocarbon productivity and other applications will be immediately apparent to those skilled in the art.

In certain embodiments of the invention communication from the communication line to a surface data acquisition system may comprise wireless telemetry. The surface data acquisition system need not be at the well site, for example it may be a networked system including a computer at the well site and a second system at some remote location. The data transmitted may optionally be used to control the operation, whereby the pump rate or the composition of a treatment fluid is adjusted based purely upon the downhole data collected and transmitted by the communication line, or from a combination of downhole data and surface measurements.

As used herein, "pumping" means using a "pumping system", which in turn means a surface apparatus of pumps, which may include an electrical or hydraulic power unit, commonly known as a powerpack. In the case of a multiplicity of pumps, the pumps may be fluidly connected together in series or parallel, and the energy conveying the pumped fluid may come from one pump or a multiplicity. The pumping system may also include mixing devices to combine different fluids or blend solids into the fluid, and the invention contemplates using downhole and surface data to change the parameters of the fluid being pumped, as well as controlling on-the-fly mixing.

By the phrase "surface acquisition system" is meant one or more computers at the well site, but also allows for the possibility of a networked series of computers, and a networked series of surface sensors. The computers and sensors may exchange information via a wireless network. Some of the computers do not need to be at the well site but may be communicating via a communication system such as that known under the trade designation InterACT™ or equivalent communication system. In certain embodiments a communication line may terminate at the wellhead at a wireless transmitter, and the downhole data may be transmitted wirelessly. The surface acquisition system may have a mechanism to merge the downhole data with the surface data and then display them on a user's console. The surface acquisition system may also include apparatus allowing communication to the downhole sensors.

Data transmitted from the communication line may be used to monitor subsequent stages of reservoir or wellbore treatment. The data transmitted may optionally be used to control some or all of the treatment operation, whereby for example a pump rate or composition of a fluid being injected is adjusted based purely on the downhole data obtained by the communication line, or from a combination of downhole data and surface measurements. The downhole data transmitted may be that from one or more sensors attached to the end of one or more communication lines, and may supplement or be supplemented by a variety of other measurements. The data may be from a distributed section of a communication line such as distributed temperature along an optical fiber. The data collected may be stored on the acquisition system and the information used to optimize and/or model subsequent stimulation runs.

Although only a few exemplary embodiments of this invention have been described in detail above, those skilled in the art may readily appreciate that many modifications are possible in the exemplary embodiments without materially departing from the novel teachings and advantages of this invention. Accordingly, all such modifications are intended to be included within the scope of this invention as defined in the following claims. In the claims, no clauses are intended to be in the means-plus-function format allowed by 35 U.S.C. §112, paragraph 6 unless "means for" is explicitly recited together with an associated function. "Means for" clauses are intended to cover the structures described herein as performing the recited function and not only structural equivalents, but also equivalent structures.

What is claimed is:

1. A method comprising:

(a) providing a coil of coiled tubing having a length able to reach a determined section of a wellbore;

(b) running one or more measured distances of the coiled tubing into the wellbore while pumping a fluid at varying flow rates down a wellhead and into the wellbore through the coiled tubing;

(c) measuring circulating pressure and pressure at bottom of the wellbore at various times during running and pumping;

(d) calculating wellbore parameters at the one or more measured distances using the pressure and flow rate data, wherein the wellbore parameters include true vertical depth of the wellbore at the one or more measured distances; and (e) cross-plotting the true vertical depth versus the measured distances as a function of time.

2. The method of claim 1 comprising pumping a sequence of fluids through the coiled tubing at known circulating pressures and flow rates, sending bottom-hole data to the surface, and fitting the data to estimate a wellbore schematic assuming a minimal radius of curvature for the wellbore.

3. The method of claim 1 comprising transmitting real-time wellbore pressure data to the surface using one or more methods selected from wireless methods, wire methods via a data-carrying wire, fiber-optic lines, and combinations thereof.

4. The method of claim 3 comprising supplying the coiled tubing to a well site spooled onto a reel, selected from a communication line already inserted into the spool, and inserting a communication line into the coiled tubing at the well site.

5. The method of claim 1 comprising modeling friction pressure in the coiled tubing as two components:

$$\text{friction pressure}=A_1*(\text{flow rate})^{n1}+A_2*(\text{flow rate})^{2n}$$

where the first term to the right of the equal sign represents the pressure drop along that part of the coil spooled onto a reel, the second term to the right to the equal sign represents the pressure drop along the unspooled coil, and $A_1$ and $A_2$ are a function of viscosity of the fluid, local friction effects and internal diameter of the coiled tubing, and wherein n is an exponent between 1 and 2.

6. The method of claim 1 comprising measuring bottom-hole pressure without a downhole electronics package.

7. The method of claim 1 comprising repeating steps (b), (c), and (d) during repeated passes of the tubing through the wellbore.

8. The method of claim 1 wherein the running one or more measured distances of the coiled tubing into the wellbore comprises running into wellbores selected from the group consisting of substantially vertical wellbores, deviated wellbores, and combinations thereof.

9. The method of claim 1 wherein cross-plotting comprises cross-plotting the true vertical depth versus the measured distances as a function of time to create a wellbore schematic while flowing fluids into the wellbore.

10. A method, comprising (a) providing a coil of coiled tubing having a length able to reach a determined section of a wellbore;

(b) running one or more measured distances of the coiled tubing into the wellbore while pumping a fluid at varying flow rates through the coiled tubing;

(c) measuring circulating pressure and pressure at bottom of the wellbore at various times during running and pumping;

(d) calculating wellbore parameters at the one or more measured distances using the pressure and flow rate data, wherein the wellbore parameters include true vertical depth of the wellbore at the one or more measured distances; and (e) modeling circulation pressure wherein a total of LT feet of coiled tubing is brought to the wellhead and MD(t) has been run into the wellbore at time t, and the friction pressure is modeled as:

$$\text{friction pressure}=a_1*(LT-MD(t))*(\text{flow rate}(t))^{n1}+a_2*MD(t)*(\text{flow rate}(t))^{n2}$$

where coefficients $a_1$ and $a_2$ are a function of viscosity of the fluid, local friction effects and internal diameter of the coiled tubing, and wherein n is an exponent between 1 and 2 and wherein $a_1$ and $a_2$, and exponents n1 and n2 are estimated by varying the flow rate and measured distance.

11. The method of claim 10 comprising assuming the fluid density remains constant so that hydrostatic pressure=TVD (t)*density*g.

12. The method of claim 10 comprising assuming the fluid density is changing with wellbore depth into a vertical wellbore, measuring a difference between fluid pressure just outside a terminus of the coiled tubing ($P_{an}$) and pressure at an annulus exit at the wellhead (WHP), and calculating fluid density using the equation:

$$P_{an} - WHP = MD \cdot \rho_{an} \cdot g \cdot \left(1 + \frac{f \cdot k_{geo}}{g} \cdot v_{an}^2\right),$$

wherein MD is measured distance of coiled tubing in the wellbore; f is the friction coefficient; kgeo is a constant that depends on geometry of the annulus; ρan is density of fluid in the annulus; g is the gravity acceleration constant; and υ is annulus fluid velocity.

13. The method of claim 10 comprising assuming the fluid density is changing with wellbore depth in a wellbore having a vertical portion and a deviated portion, measuring a difference between fluid pressure just outside a terminus of the coiled tubing ($P_{an}$) and pressure at an annulus exit at the wellhead (WHP), and calculating fluid density using the equation:

$$\frac{P_{an} - WHP}{MD} = \rho_{an} \cdot (f \cdot k_{geo} \cdot v_{an}^2 + g \cdot m) + \rho_{an} \cdot g \cdot (1 - m) \cdot \frac{MD_0}{MD},$$

wherein MD is measured distance of coiled tubing in the wellbore; f is the friction coefficient; $k_{geo}$ is a constant that depends on geometry of the annulus; $\rho_{an}$ is density of fluid in the annulus; g is the gravity acceleration constant; $\upsilon$ is annulus fluid velocity; m is the cosine of a deviation angle; and $MD_0$ is measured depth of a vertical portion of the wellbore.

14. The method of claim 10 wherein the MD is varied during the time the coiled tubing is running in.

15. The method of claim 10 further comprising performing at least one wellbore servicing operation.

16. A method comprising:

(a) running one or more measured distances of coiled tubing into a wellbore while pumping a fluid at varying flow rates down a wellhead and into the wellbore through the coiled tubing;

(b) calculating true vertical depth of the wellbore using pressure and flow rate data of the fluid; and (c) cross-plotting the true vertical depth versus the measured distances as a function of time.

* * * * *